US010755879B2

(12) United States Patent
Ozil et al.

(10) Patent No.: US 10,755,879 B2
(45) Date of Patent: Aug. 25, 2020

(54) CIRCUIT BREAKER COMPRISING AN IMPROVED COMPRESSION CHAMBER

(71) Applicant: General Electric Technology GmbH, Baden (CH)

(72) Inventors: Joel Ozil, Saint Andéol le Château (FR); Matthieu Barre, St André de Corcy (FR); Cedrid Delhomme, Trept (FR); Nadia Hasnaoui, Lyons (FR)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 15/983,345

(22) Filed: May 18, 2018

(65) Prior Publication Data

US 2018/0337012 A1 Nov. 22, 2018

(30) Foreign Application Priority Data

May 19, 2017 (EP) ..... 17290066

(51) Int. Cl.
*H01H 33/90* (2006.01)
*H01H 33/91* (2006.01)
*H01H 33/86* (2006.01)

(52) U.S. Cl.
CPC ..... *H01H 33/905* (2013.01); *H01H 33/86* (2013.01); *H01H 33/904* (2013.01); *H01H 33/91* (2013.01); *H01H 2033/908* (2013.01)

(58) Field of Classification Search
CPC .... H01H 33/905; H01H 33/91; H01H 33/904; H01H 33/86; H01H 33/56; H01H 33/74; H01H 33/88; H01H 33/884; H01H 33/95; H01H 2033/906; H01H 33/182; H01H 2033/908
(Continued)

(56) References Cited

U.S. PATENT DOCUMENTS 4,220,838 A * 9/1980 Thaler ..... H01H 33/91 218/66
5,293,014 A * 3/1994 Perret ..... H01H 33/905 218/57
(Continued)

FOREIGN PATENT DOCUMENTS

EP 0540971 A1 5/1993
WO 99/12177 A1 3/1999
WO 2010/040574 B2 4/2010

OTHER PUBLICATIONS

Extended Search Report issued in European Patent Application No. 17290066.4, dated Nov. 20, 2017, 12 pages.

*Primary Examiner* — William A Bolton
(74) *Attorney, Agent, or Firm* — Eversheds Sutherland (US) LLP

(57) ABSTRACT

A circuit breaker including a stationary frame, at least a pair of arc contacts, an actuation rod, a compression chamber in which a portion of the dielectric gas is compressed; a cylinder and a piston connected with the rod, which are movable within the stationary frame along main axis, for compressing the portion of the dielectric gas in the compression chamber; a link mechanism connecting the piston to the rod, wherein the stationary frame includes a cylindrical portion with which each of the piston and of the cylinder are radially in gastight contact and which bounds the compression chamber together with the piston and the cylinder.

14 Claims, 4 Drawing Sheets

(58) Field of Classification Search
USPC ..... 218/60, 57, 59, 61, 54
See application file for complete search history.

(56) References Cited

U.S. PATENT DOCUMENTS

| | | | | | |
|---|---|---|---|---|---|
| 5,898,149 | A * | 4/1999 | Berger | H01H 33/904 | 218/60 |
| 6,207,918 | B1 * | 3/2001 | Lorenz | H01H 33/903 | 218/59 |
| 6,515,248 | B2 * | 2/2003 | Imamura | H01H 33/91 | 218/43 |
| 7,339,132 | B2 * | 3/2008 | Urai | H01H 33/904 | 218/57 |
| 8,013,268 | B2 * | 9/2011 | Ozil | H01H 33/904 | 218/1 |
| 8,816,237 | B2 * | 8/2014 | Dufournet | H01H 33/905 | 218/46 |
| 9,029,726 | B2 * | 5/2015 | Cernat | H01H 33/91 | 218/43 |
| 2011/0163069 | A1 * | 7/2011 | Ohlsson | H01H 33/901 | 218/66 |
| 2013/0168357 | A1 * | 7/2013 | Yaginuma | H01H 33/08 | 218/57 |
| 2014/0190938 | A1 * | 7/2014 | Tsukushi | H01H 33/905 | 218/63 |

* cited by examiner

CIRCUIT BREAKER COMPRISING AN IMPROVED COMPRESSION CHAMBER

FIELD OF THE INVENTION

Embodiments of the invention relate to a circuit breaker comprising compression chamber bounded by a piston and a cylinder movable inside a stationary frame.

Embodiments of the invention particularly relate to a circuit breaker wherein the relative movement of the piston and the cylinder is improved.

BACKGROUND OF THE INVENTION

In a circuit breaker, a compression chamber is used in order to compress a quantity of dielectric gas filling the compression chamber, in order to blast an electric arc forming between two contacts of the circuit breaker, during a separation operation of the contacts.

In a known embodiment, for example in document FR2435795, the compression chamber comprises a cylinder and a piston which are in gastight contact with each other and which bound the compression chamber.

During the separation operation, the cylinder and the piston move in opposite direction one respective to the other.

The relative speed of displacement of the piston with respect to the cylinder equals the sum of the speed of both these components relative to a stationary frame of the circuit breaker.

Such speed is relatively high, this generates important friction between the cylinder and the guiding of the piston with respect to the stationary frame is relatively complex due to the radial tolerance stack.

Embodiments of the invention aim to propose a circuit breaker wherein the friction between the different parts is lowered in relation to the prior art.

SUMMARY OF THE INVENTION

Embodiments of the invention concern a circuit breaker including an airtight container filled with a dielectric gas; a stationary frame arranged inside the container defining a volume with a main axis A; at least a pair of arc contacts, the arc contacts being separable from each other; an actuation rod that drives one of the arc contacts in a separation direction along main axis A, inside the volume defined by the frame, upon a separation operation between the arc contacts; a compression chamber in which a portion of the dielectric gas is compressed during the separation operation to blast an electric arc formed between the arc contacts during the separation operation; a cylinder and a piston connected with the rod, which are movable within the stationary frame along main axis A, for compressing said portion of the dielectric gas in the compression chamber upon the separation operation; a link mechanism connecting the piston to the rod, wherein the stationary frame comprises a cylindrical portion with which each of the piston and of the cylinder are radially in gastight contact and which bounds the compression chamber together with the piston and the cylinder.

According to this solution, the piston and the cylinder only contact with the stationary frame. Consequently, the relative contact speed of the piston and of the cylinder with respect to the frame is their respective speed.

In an embodiment, a first axial end of the compression chamber is bound by the piston, a second end of the compression chamber is bound by the cylinder, and the compression chamber is radially bounded by a portion of the cylindrical portion of the stationary frame.

In an embodiment, the cylindrical portion of the stationary frame comprises an orifice which communicates with the internal volume of the compression chamber through the piston for allowing dielectric gas to fill the compression chamber during a closing operation of the circuit breaker.

In an embodiment, the piston comprises two radial collars which are in a gastight cooperation with the cylindrical portion of the stationary frame, which are axially distant one with respect to the other and wherein the radial collars axially bound an annular chamber which said annular chamber is in communication with said orifice of the cylindrical portion of the stationary frame.

In an embodiment, the piston comprises a first valve located between said orifice of the cylindrical portion of the stationary frame and the compression chamber.

In an embodiment, the first valve is mounted on the radial collar which is axially located closer to the cylinder.

In an embodiment, the piston comprises a pressure relief valve which is able to open when pressure of dielectric gas in the compression chamber exceeds a threshold value during the separation operation of the circuit breaker.

In an embodiment, the link mechanism comprises a lever articulated with respect to the stationary frame, which is connected to the piston and to the rod to move the piston in a direction opposite to the separation direction during an initial stage of the separation operation, until the rod attains a particular axial location, along main axis A.

In an embodiment, the lever is connected to the piston and to the rod in order to move the piston in the separation direction during a final stage of the separation operation, when the rod got through said particular axial location, along main axis A.

In an embodiment, the lever comprises three articulation points, which are not aligned and which are respectively connected to the frame, the rod and the piston.

In an embodiment, the lever is connected to the piston by a first crank and to the rod by a second crank.

In an embodiment, the lever is connected to the piston and to the rod so that the piston remains stationary during a final stage of the separation operation, when the rod got through said particular axial location, along main axis A.

In an embodiment, the lever is connected to the piston by a first crank and comprises a slot cooperating with a pin mounted on the rod.

In an embodiment, the slot comprises a first segment which axis is aligned with the articulation point of the lever with the frame and a second segment which is parallel to main axis A when the rod got through said particular axial location, along main axis A.

In an embodiment, when the rod attains the particular axial location, the articulation point of the lever with the frame is aligned with both ends of the first crank.

BRIEF DESCRIPTION OF THE DRAWINGS

Other characteristics and advantages of embodiments of the invention appear on reading the following detailed description, for understanding of which reference is made to the accompanying drawing, in which.

DETAILED DESCRIPTION

Figure 1:
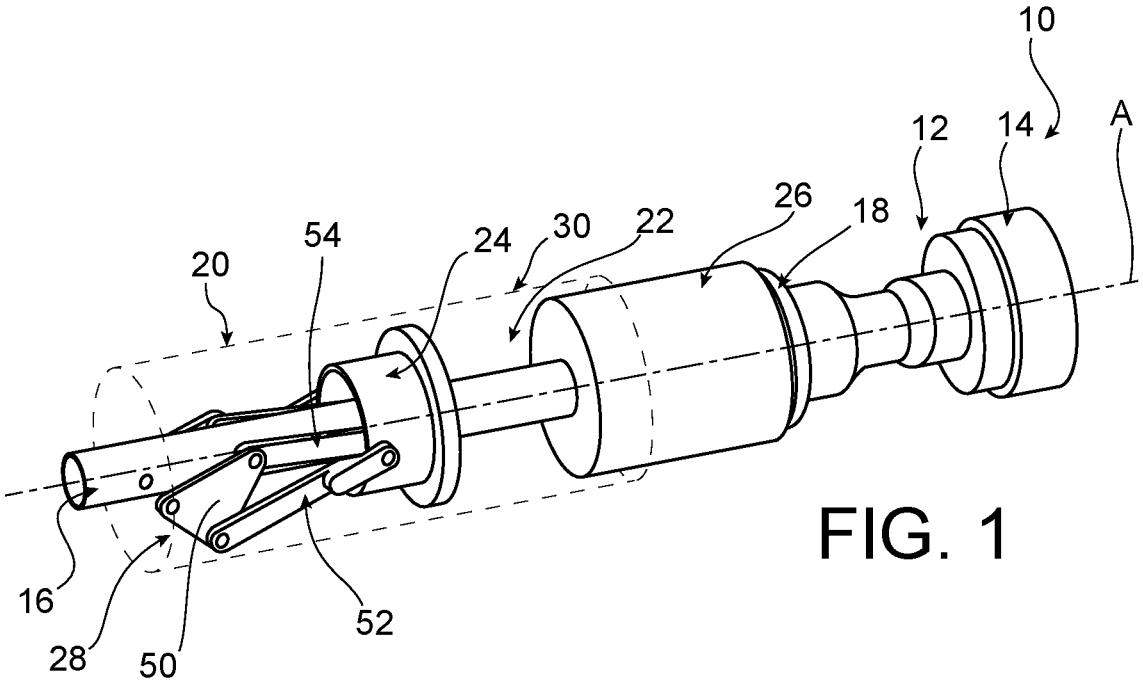
FIG. 1 is a perspective view of a circuit breaker.
Figure 5:
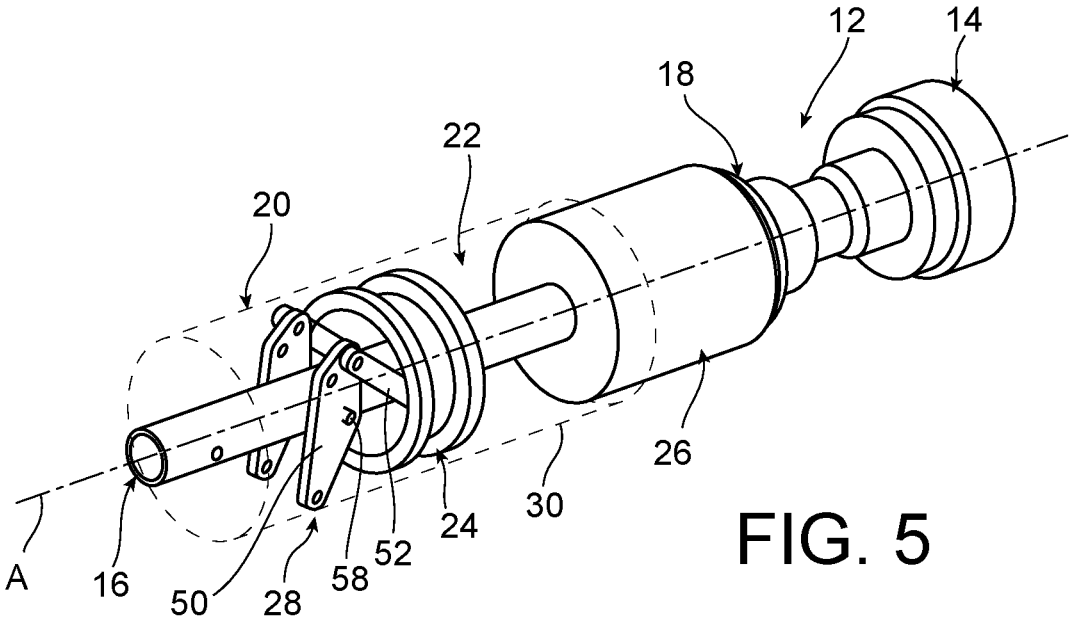
FIG. 5 is a perspective view of a circuit breaker.
Figure 6:
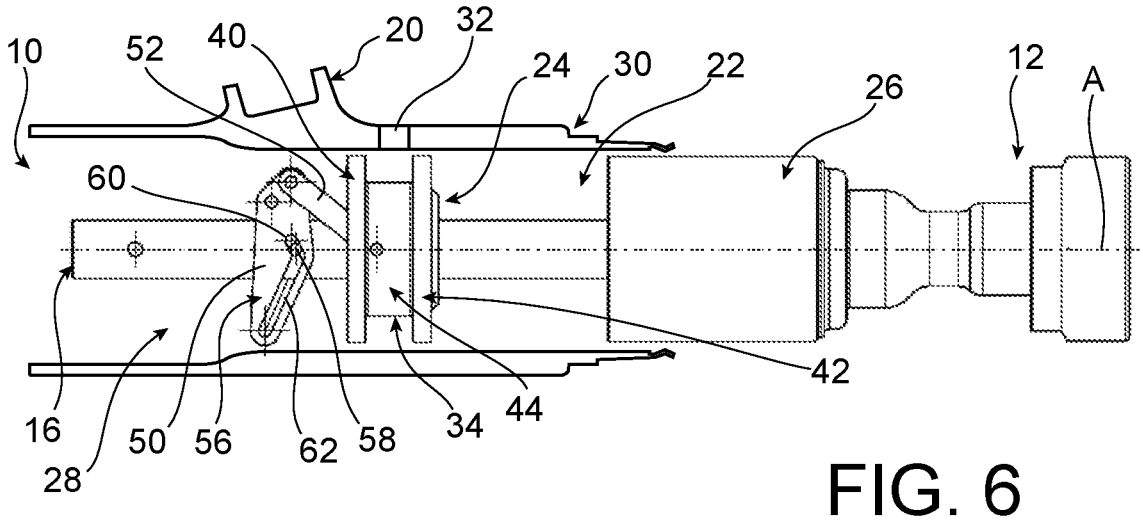
FIGS. 6 to 8 are sections along an axial plane of the circuit breaker represented on FIG. 5, representing different operation times of the circuit breaker.

A circuit breaker 10 is represented on FIGS. 1 and 5.

The circuit breaker 10 comprises a main axis A, which is here horizontal, a movable contact 12 and a stationary contact (not represented).

The movable contact 12 comprises a first axial end 14, which is here the downstream end of the movable contact 12 and that is designed to cooperate with the stationary contact when the circuit breaker is in a closed configuration.

The displacement of the movable contact 12 is attained by an actuation rod 16 extending axially along main axis A of the circuit breaker 10. The rod 16 is connected to a second axial end 18 of the movable contact 12, here the upstream end of the movable contact 12.

The circuit breaker 10 also comprises a stationary frame 20 which is stationary with respect to the container. The stationary frame 20 is substantially rotationally symmetric and is coaxial with main axis A of the circuit breaker.

During a separation operation of the circuit breaker 10, an electric arc forms between the movable contact 12 and the stationary contact. The contacts are designed to withstand the formation of this arc, they are then commonly named as arc contacts.

In order to limit the formation of this arc, the circuit breaker 10 comprises an airtight container (not shown) filled with a dielectric gas in which the contacts 12 are arranged.

Also, the circuit breaker 10 comprises means for blasting the arc by projecting dielectric gas at a high pressure towards the electric arc.

The means for blasting comprise a compression chamber 22 in which a portion of the dielectric gas is compressed during the separation operation and which opens towards the downstream end 14 of the movable contact 12.

The compression chamber 22 is arranged inside the stationary frame 20 and is mostly coaxial with main axis A of the circuit breaker 10.

Figure 2:
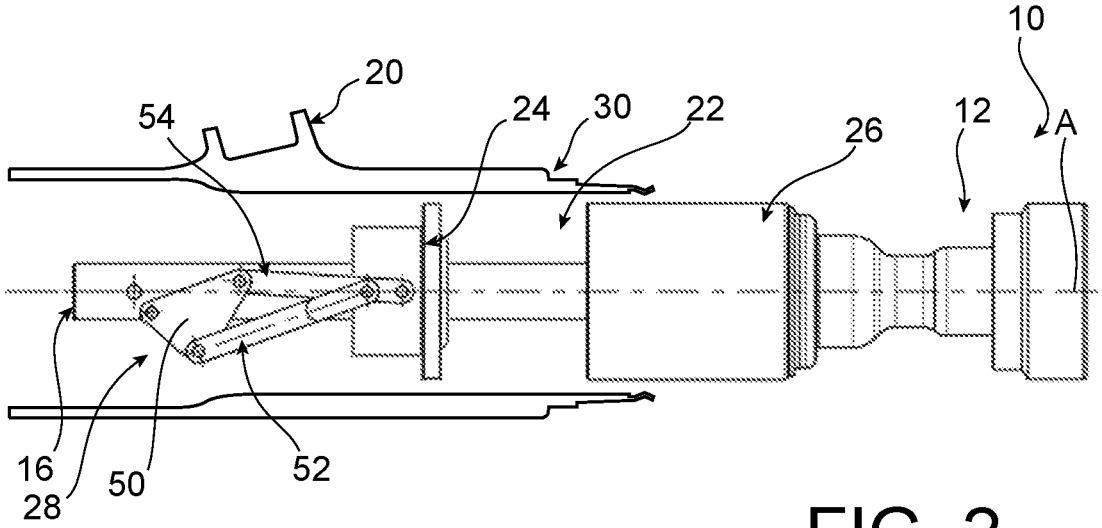
FIGS. 2 to 4 are sections along an axial plane of the circuit breaker represented on FIG. 1, representing different operation times of the circuit breaker.

As it can be seen more precisely on FIG. 2, the upstream end of the compression chamber 22 is defined by a piston 24 and the downstream end of the compression chamber 22 is defined by a cylinder 26.

The piston 24 is an element of revolution centered on main axis A of the circuit breaker 10 and extends in a plane perpendicular to main axis A.

The cylinder is an element or revolution centered on main axis A of the circuit breaker 10 and delimits an inner volume which is opened axially at the upstream end of the cylinder 26 and forms a part of the compression chamber 22.

Both of the piston 24 and the cylinder 26 are movable within the stationary frame 20 and they are connected to the actuation rod 16 by a link mechanism 28 to be driven in movement during a separation operation and a closing operation of the circuit breaker 10.

The compression chamber 22 is also defined by a portion 30 of the stationary frame 20.

This portion 30 of the stationary frame comprises a cylindrical inner face with which the piston 24 and the cylinder 26 are radially in gastight contact.

Then, during operation of the circuit breaker 10, the piston only contacts the portion 30 of the stationary frame 20, the friction between the piston 24 and the portion 30 of the stationary frame 20 only depends on the speed of the piston 12, which is lower than the sum of the absolute values of the speeds of the piston 24 and the cylinder 26.

The same applies to the friction between the cylinder 26 and the portion 30 of the stationary frame 20.

Also, the guiding means for each of the piston 24 and the cylinder 26 are designed with respect to the stationary frame 20, this permit to improve these guiding means so that the piston 24 can have a better axial translation in the circuit breaker 10.

The link mechanism 28 is designed so that during a separation operation of the circuit breaker 10, the piston 24 and the cylinder 26 move along main axis A of the circuit breaker 10 towards each other.

Also, the piston 24 and the cylinder 26 move in opposite directions during an initial stage of the separation operation, in order to have a quick rise of the pressure in the compression chamber 22.

The end of the initial stage is when the electric arc appears, so that it is blown with the most efficiency.

Figure 3:
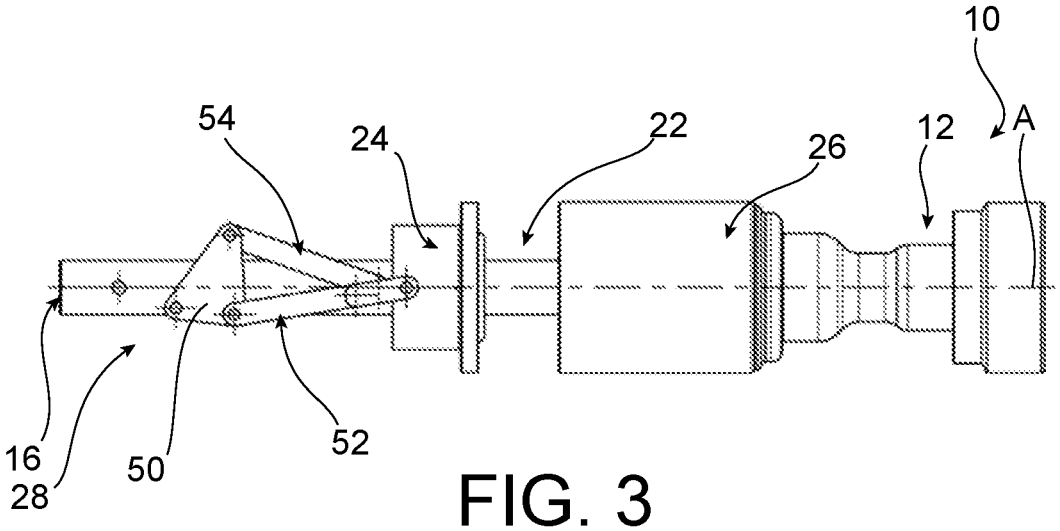
Figure 4:
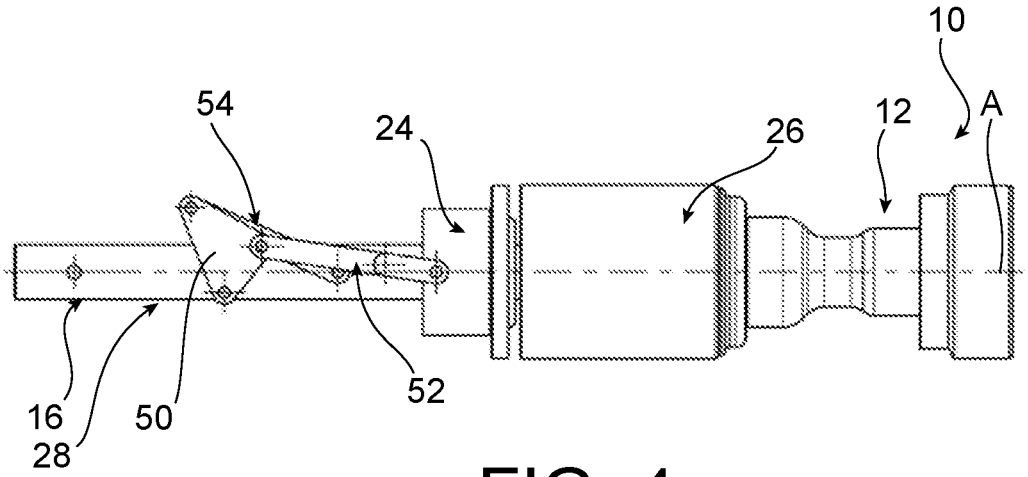
Figure 7:
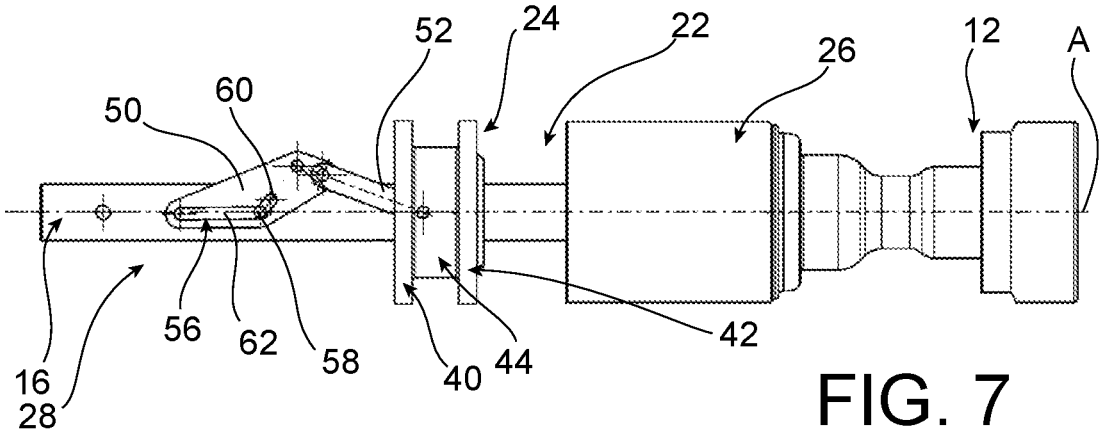

When the rod 16 attains a specific location along main axis A, the piston 24 stops moving towards the cylinder. This specific location is represented on FIGS. 3 and 7 and corresponds to the end of the initial stage of the separation operation, According to a first embodiment represented on FIG. 4, the piston moves in the same direction than the cylinder 26 when the rod 16 goes through this specific location.

Figure 8:
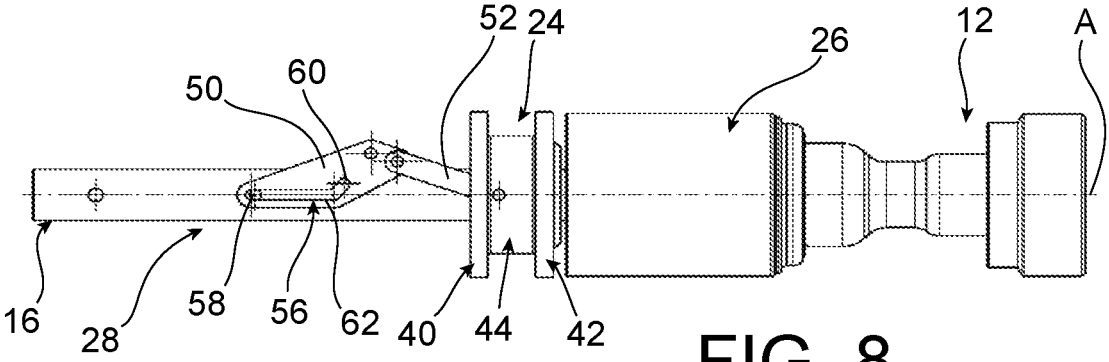

According to a second embodiment represented on FIG. 8, the piston 24 remains stationary with respect to the stationary frame 20 when the rod 16 goes through this specific location.

During a closing operation of the circuit breaker 10, the piston 24 and the cylinder 26 perform the opposite movements than during the separation operation.

During the opening operation, a quantity of dielectric gas exits the compression chamber 22. During the closing operation, the compression chamber 22 is filled back with dielectric gas.

Figure 9:
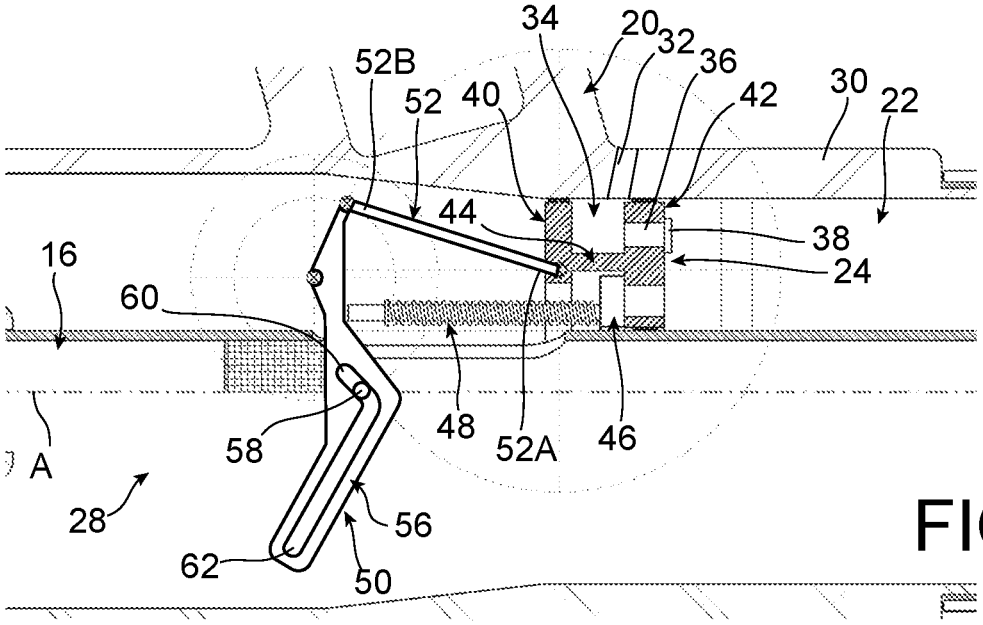
FIG. 9 is a more detailed view of the circuit breaker, showing the different valves on the piston.

In an embodiment, as can be seen more specifically on FIG. 9, the dielectric gas filling back the compression chamber flows through an orifice 32 formed in the stationary frame 20.

In an embodiment, the orifice 32 is formed in the cylindrical portion 30 of the stationary frame 20 and communicates with the compression chamber 22 through the piston 24.

To this end, the piston comprises a communication volume 34 in which the orifice 32 ends up on each axial position of the piston 24 along main axis A of the circuit breaker 10.

The piston 24 comprises two radial collars 40, 42 which are in gastight cooperation with the portion 30 of the stationary frame 20 and which are axially distant one with respect to the other. A first radial collar 40 is located axially upstream of the second radial collar 42.

The piston 24 comprises a central core 44 linking the two radial collars 40, 42 one with each other. The external radius of the central core 44 is inferior to the external radius of the radial collars 40, 42.

The first radial collar 40 is also always located upstream of the orifice 32 of the portion 30 of the stationary frame 20 and the second radial collar 42 is also always located downstream of the orifice 32 of the portion 30 of the stationary frame 20. Also, the second radial collar 42 is the part of the piston 24 which delimits the compression chamber 22.

The communication volume 34 is axially bounded by the two radial collars 40, 42 and is radially bounded by the portion 30 of the stationary frame 20 and the central core 44 of the piston 24.

The piston 24 also comprises a communication opening 36 connecting the communication volume 34 with the compression chamber 22 and a valve 38 selectively closing or opening the communication opening depending on the operation of the circuit breaker 10.

The communication opening 36 is formed on the second collar 42 and the valve 38 is mounted on the downstream end face of the second radial collar 42.

During the opening operation, the inner volume of the compression chamber 22 decreases, the pressure of the dielectric gas inside the compression chamber rises as a consequence. This rise in the pressure maintains the valve in an obstruction configuration of the communication opening.

During the closing operation, the inner volume of the compression chamber 22 increases, the pressure of the dielectric gas inside the compression chamber decreases as a consequence. When the pressure drops under a predetermined pressure value, the valve 38 opens the communication opening, allowing a quantity of new dielectric gas to enter the compression chamber 22.

During the opening operation, the pressure inside the compression chamber can rise above a predefined value of pressure, there are then risks to damage parts of the circuit breaker.

To this end, the piston 24 also comprises a pressure relief valve 46, which is associated with a compression spring 48, which is able to open when the main volume of the container, in order to maintain the pressure in the inner volume of the compression chamber 22 exceeds a threshold value, in order to connect the compression chamber 22 with the main volume of the container, and to maintain the pressure in the inner volume of the compression chamber 22 under the threshold value.

The mode of carrying out embodiments of the invention comprising the two valves 38, 46 is represented in association with the second embodiment of the link mechanism 28. However, it will be understood that the piston 24 comprising these valves 38, 46 can also be implemented in the first embodiment of the link mechanism 28 represented on FIGS. 1 to 4.

As sated above, the circuit breaker comprises a link mechanism 28 connecting the piston 24 and the cylinder 26 to the rod 16.

In an embodiment, the cylinder 26 is fixed with the rod 16. Then, the cylinder 26 moves the same way than the rod 16.

As explained before, the link mechanism 28 is designed so that during a separation operation of the circuit breaker 10, the piston 24 and the cylinder 26 move along main axis A of the circuit breaker 10 towards each other.

Also, the piston 24 and the cylinder 26 move in opposite directions during an initial stage of the separation operation, in order to have a quick rise of the pressure in the compression chamber 22.

The end of the initial stage is when the electric arc appears, so that it is blown with the most efficiency.

When the rod 16 attains a specific location along main axis A, corresponding to the end of the initial stage of the separation operation, the piston 24 stops moving towards the cylinder.

The link mechanism 28 comprises a lever 50 articulated with respect to the stationary frame 20 and that is linked simultaneously to the rod 16 and the piston 24.

The lever 50 is connected to the piston 24 by a first crank 52.

A first end 52A of the crank 52 is articulated with the piston 24, the second end 52B of the crank 52 is articulated with the lever 50.

According to a first embodiment represented on FIGS. 1 to 4, the lever 50 is connected to the rod 16 by a second crank 54.

A first end 54A of the second crank 54 is articulated with the rod 16, the second end 54B of the second crank 54 is articulated with the lever 50.

It will be understood that all the articulation axis of the cranks 52, 54 and of the lever 50 are parallel and are orthogonal to the main axis A of the circuit breaker 10.

According to this first embodiment, the lever 50 comprises three articulation points which are respectively connected to the stationary frame 20, the piston 24 and the rod 16.

In an embodiment, these articulation points are located on the lever 50 so that they are not aligned, that is to say they are located on the summits of a non-flat triangle.

As explained before, the link mechanism 28 is designed so that the piston 24 moves in an opposite direction than the cylinder 26 during a first stage of the opening operation. Then, the piston 24 moves downstream, as the cylinder 26 moves upstream, together with the movable contact 12.

Moreover, here, during the second stage of the opening operation, the piston 24 moves in the same direction than the cylinder 26, that is to say the piston 24 moves upstream, and the speed of the piston 24 is lower than the speed of the cylinder 26, to maintain a decrease of the internal volume of the compression chamber 22.

According to a second embodiment of the link mechanism 28 represented on FIGS. 5 to 9, the lever 50 is connected to the rod 16 by a set of a slot 56 and a cooperating pin 58.

The slot 56 is formed in the lever 50 and the pin 58 is fixed on the rod 16. During the displacement of the rod 16, the pin 58 moves in the slot 56 to obtain a specified position of the lever 50 with respect to the stationary frame 20.

The slot 56 comprises a first segment 60 in which the pin 58 moves during the first stage of the opening operation and a second segment 62 in which the pin 58 moves during the second stage of the opening operation.

Here, the first segment 60 is rectilinear and its main axis is aligned with the articulation point of the lever 50 with the stationary frame 20.

The second segment 62 is also rectilinear and its orientation is set so that it is parallel to main axis A of the circuit breaker 10 when the pin 58 moves in the second segment 62.

As a consequence of this orientation of the second segment, the lever 50 doesn't rotate during the second stage of the opening operation.

At the end of the first stage of the opening operation, the rod 16 attains a particular axial position along main axis A in which the pressure in the internal volume of the compression chamber 22 is at its maximum value.

In an embodiment, when the rod 16 is at this particular axial position, the design of the link mechanism 28 is so that the force exerted on the piston 24 by the compressed gas in the compression chamber is not transferred to the rod 16.

To this end, according to the first embodiment and the second embodiment, the link mechanism is designed so that the two ends 52A, 52B of the first crank 52 are aligned with the articulation point of the lever 50 with the stationary frame 20.

Then, the effort is directly transmitted to the stationary frame 20.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A circuit breaker comprising:

an airtight container filled with a dielectric gas;

a stationary frame arranged inside the container defining a volume with a main axis;

at least a pair of arc contacts, the pair of arc contacts being separable from each other;

an actuation rod that drives a first arc contact, of the pair of arc contacts, in a separation direction along the main axis inside the volume defined by the frame, upon a separation operation between the pair of arc contacts, wherein the actuation rod is connected to a second axial end of the first contact;

a compression chamber in which a portion of the dielectric gas is compressed during the separation operation to blast an electric arc formed between the arc contacts during the separation operation;

a cylinder and a piston connected with the rod, which are movable within the stationary frame along the main axis, for compressing the portion of the dielectric gas in the compression chamber upon the separation operation;

a link mechanism connecting the piston to the rod, wherein the stationary frame comprises a cylindrical portion with which each of the piston and of the cylinder are radially in gastight contact and which bounds the compression chamber together with the piston and the cylinder, and wherein the cylindrical portion of the stationary frame comprises an orifice which communicates with an internal volume of the compression chamber through the piston allowing dielectric gas to fill the compression chamber during a closing operation of the circuit breaker; and wherein the piston comprises two or more radial collars forming at least one annular chamber in communication with the orifice of the cylindrical portion of the stationary frame.

2. The circuit breaker according to claim 1, wherein a first axial end of the compression chamber is bound by the piston, a second end of the compression chamber is bound by the cylinder, and the compression chamber is radially bounded by a portion of the cylindrical portion of the stationary frame.

3. The circuit breaker according to claim 1, wherein the piston comprises two radial collars which are in a gastight cooperation with the cylindrical portion of the stationary frame, which are axially distant one with respect to the other and wherein the radial collars axially bound an annular chamber which the annular chamber is in communication with the orifice of the cylindrical portion of the stationary frame.

4. The circuit breaker according to claim 1, wherein the piston comprises a first valve located between the orifice of the cylindrical portion of the stationary frame and the compression chamber.

5. The circuit breaker according to claim 4 wherein the first valve is mounted on the radial collar which is axially located closer to the cylinder.

6. The circuit breaker according to claim 1, wherein the piston comprises a pressure relief valve configured to open when a pressure of dielectric gas in the compression chamber exceeds a threshold value during the separation operation of the circuit breaker.

7. The circuit breaker according to claim 1, wherein the link mechanism comprises a lever articulated with respect to the stationary frame, which is connected to the piston and to the rod to move the piston in a direction opposite to the separation direction during an initial stage of the separation operation, until the rod attains a particular axial location, along main axis.

8. The circuit breaker according to claim 7, wherein the lever is connected to the piston and to the rod in order to move the piston in the separation direction during a final stage of the separation operation, when the rod got through the particular axial location, along main axis.

9. The circuit breaker according to claim 8, wherein the lever comprises three articulation points, which are not aligned and which are respectively connected to the frame, the rod and the piston.

10. The circuit breaker according to claim 9, wherein the lever is connected to the piston by a first crank and to the rod by a second crank.

11. The circuit breaker according to claim 10, wherein when the rod attains the particular axial location, an articulation point of the lever with the frame is aligned with both ends of the first crank.

12. The circuit breaker according to claim 7, wherein the lever is connected to the piston and to the rod so that the piston remains stationary during a final stage of the separation operation, when the rod got through the particular axial location, along main axis.

13. The circuit breaker according to claim 12, wherein the lever is connected to the piston by a first crank and comprises a slot cooperating with a pin mounted on the rod.

14. The circuit breaker according to claim 13, wherein the slot comprises a first segment which axis is aligned with an articulation point of the lever with the frame and a second segment which is parallel to main axis when the rod got through the particular axial location, along main axis.

* * * * *